United States Patent [19]

Kreutel, Jr.

[11] 4,254,421

[45] Mar. 3, 1981

[54] INTEGRATED CONFOCAL ELECTROMAGNETIC WAVE LENS AND FEED ANTENNA SYSTEM

[75] Inventor: Randall W. Kreutel, Jr., Rockville, Md.

[73] Assignee: Communications Satellite Corporation, Washington, D.C.

[21] Appl. No.: 100,621

[22] Filed: Dec. 5, 1979

[51] Int. Cl.[3] ..... H01Q 15/08

[52] U.S. Cl. ..... 343/754; 343/854

[58] Field of Search ..... 343/753, 754, 755, 854, 343/911 R

[56] References Cited

U.S. PATENT DOCUMENTS 3,550,139 12/1970 McFarland ..... 343/754

*Primary Examiner*—Eli Lieberman

*Attorney, Agent, or Firm*—Sughrue, Rothwell, Mion, Zinn and Macpeak

[57] ABSTRACT

A lens system is formed of spaced coaxial hyperboloidal primary and secondary lenses, each having a convex surface described by a hyperboloidal eccentricity equal to the refractive index of the lens with the lenses mounted with their convex surfaces facing each other, and with the lenses having equal beam deviation factors. A feed array is integrated with the secondary lens, with the feed array comprising array elements printed on a substrate which, in turn, is backed by a ground plane. A beam forming and control network is directly connected to the substrate at the ground plane.

8 Claims, 4 Drawing Figures

INTEGRATED CONFOCAL ELECTROMAGNETIC WAVE LENS AND FEED ANTENNA SYSTEM

FIELD OF THE INVENTION

This invention relates to an antenna system employing confocal paraboloidal lenses, and more particularly, to an antenna system in which a feed array is integrated with the secondary confocal paraboloidal lens.

BACKGROUND OF THE INVENTION

Well known confocal antenna systems employ confocal paraboloids. Such confocal systems have the advantage of abberation correction. However, because such system constitutes a reflecting device, it must be offset fed. Consequently, the resulting system is asymmetric and gives rise to some limitations. Also, in order to intercept feed radiation, a subreflector must be quite large relative to the other elements of the optical system.

It is, therefore, a primary object of the present invention to provide a microwave transmission system characterized by the absence of reflection which eliminates the necessity for offset feed and which is symmetrical in all respects.

It is a further object of the present invention to provide an improved confocal electromagnetic wave lens and feed antenna system in which the feed array elements are intrinsically matched to the lens media, and wherein the array elements, ground plane and microwave beam forming and control network are efficiently packaged with the lens as an integrated assembly.

It is a further object of the present invention to provide an integrated confocal electromagnetic wave lens and feed antenna system in which the secondary lens and the feed array are integrated, thereby effecting a secondary lens having minimum weight and diameter.

It is a further object of the present invention to provide an integrated confocal electromagnetic wave lens and feed antenna system wherein the feed array size is effectively magnified by the magnification of the lens system, whereby a large array performance can be realized with a small array, and wherein the primary aberrations such as coma and astigmatism are reduced or completely eliminated.

SUMMARY OF THE INVENTION

The present invention is directed to an integrated confocal electromagnetic wave lens and feed system which employs spaced, coaxial parabolic primary and secondary lenses. Each of the lenses has a planar surface and a convex surface described by a hyperboloidal eccentricity equal to the refractive index of the lens. The lenses are mounted with their convex surfaces facing each other, and the lenses preferably have equal deviation factors such that for small scan angles, $$\phi = m\theta$$

where $\phi$ is the angle of incidence of a plane wave on the secondary lens, m is the magnification of the lens system, and $\theta$ is the angle of emergence of the plane wave from the primary lens, The system further comprises a feed array integrated with the secondary lens, with the feed array comprising array elements printed on a substrate. The substrate is backed by a ground plane and is directly connected, at the ground plane, to a microwave beam forming and control network. The substrate may have the same refractive index as the lens.

Further, the array elements may constitute a regular grid of elements, and the elements spacing in the array may satisfy the inequality:

$$\frac{d}{\lambda} \leq \frac{1}{n + \sin\theta_s}$$

wherein:

d is the distance between elements, $\lambda$ is the wave length of transmitted electromagnetic wave energy, n is the refractive index of the substrate, and $\theta_s$ is the maximum value of $\theta$.

DESCRIPTION OF PREFERRED EMBODIMENTS

Figure 1:
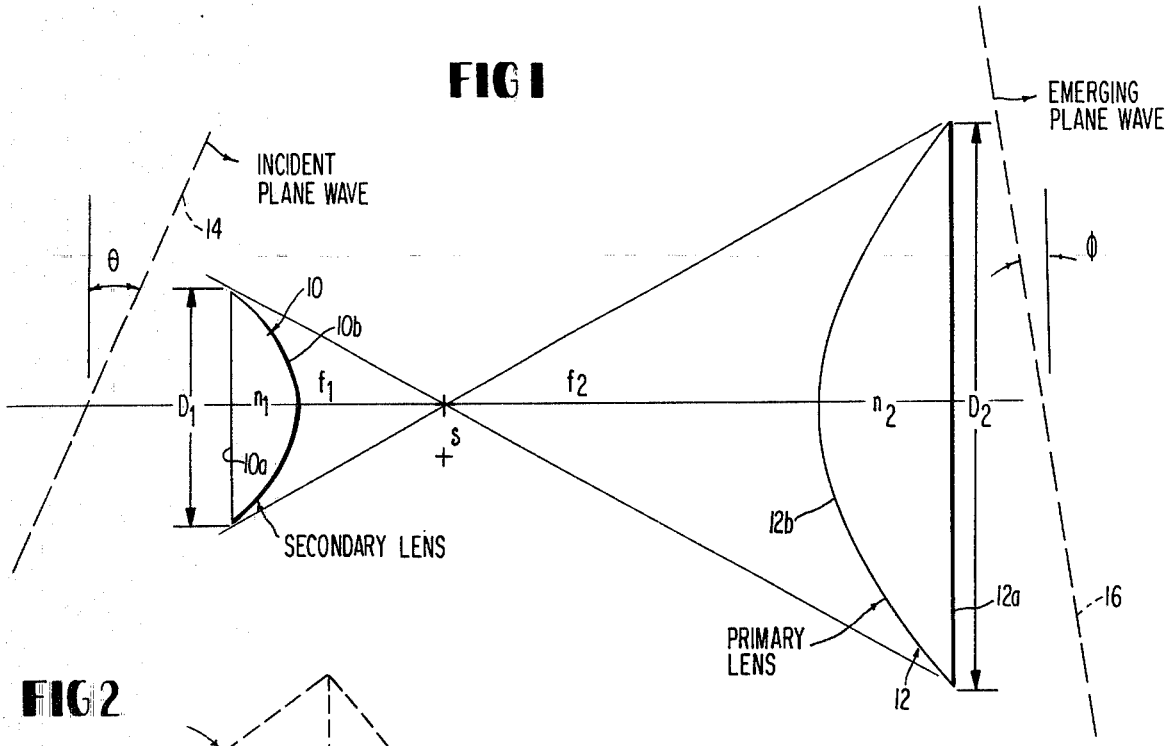
FIG. 1 is a schematic diagram of the spaced, coaxial, hyperboloidal primary and secondary lenses forming a part of the integrated confocal microwave lens and feed antenna system of the present invention.

Referring to the drawings, FIG. 1 shows schematically the improved confocal lens system forming a part of the integrated confocal electromagnetic wave lens and feed antenna system of the present invention, the invention being characterized by a confocal lens system which is a transmission system, i.e., no reflection, and therefore, need not be offset fed. Thus, as seen, this system constitutes a symmetrical system wherein the secondary lens 10 is coaxial with the primary lens 12 and spaced therefrom. The lenses are confocal hyperboloids. Confocal hyperboloidal secondary lens 10 has a focal length, diameter and refractive indices of $F_1$, $D_1$ and $n_1$, respectively. The primary confocal hyperboloidal lens 12 has a focal length, diameter and refractive index of $F_2$, $D_2$and $n_2$, respectively. Each lens has a planar surface and a convex surface described by a hyperboloidal eccentricity equal to the refractive index. For secondary lens 10, the planar surface is shown at $\mathbf{10}_a$ and the convex surface at $\mathbf{10}_b$, while for the primary lens 12, the planar surface is shown at $\mathbf{12}_a$ and the convex surface is shown at $\mathbf{12}_b$. An incident plane wave, shown in dotted line at 14 having an angle of incidence $\theta$ with planar surface $\mathbf{10}_a$ of the secondary lens 10, will converge on a point $\delta$ at the focal axis, where:

$$\delta = F_1 \operatorname{Tan}\left(\frac{\theta}{BDF}\right) \quad (1)$$

where:

BDF is the beam deviation factor and $F_1$ is the focal axis for the secondary lens. The energy will be recollimated by the second lens (primary lens 12) and emerge at an emerging plane wave angle $\phi$ such that:

$$\delta = F_2 \operatorname{Tan}\left(\frac{\theta}{BDF}\right) \quad (2)$$

where:

$\phi$ is the angle of emergence of the plane wave from the primary lens planar surface $12_a$, and $F_2$ is the focal length of the primary lens.

Equating (1) and (2) gives $$\frac{\operatorname{Tan}\frac{\theta}{BDG}}{\operatorname{Tan}\frac{\theta}{BDF}} = \frac{F_1}{F_2} = \frac{1}{m} \quad (3)$$

where m is the magnification of the lens system.

If the lens parameters are chosen such that their beam deviation factors are the same (ordinarily so chosen since this is the condition for cancellation of primary coma), then for small scan angles:

$$\theta = m\phi$$

Figure 2:
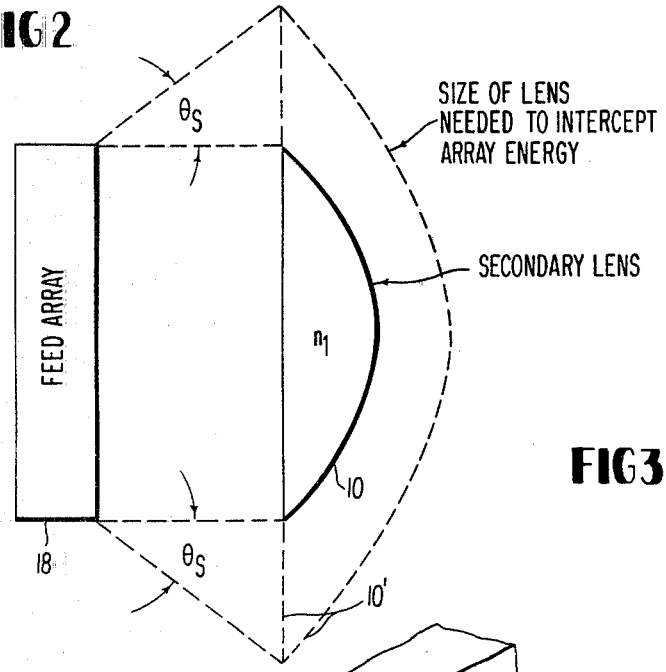
FIG. 2 is a schematic representation of the secondary lens and the feed array for generating the incident plane wave and showing the need normally for a relatively large secondary lens absent the integration of confocal secondary lens and feed components in accordance with the present invention.

Referring next to FIG. 2, the incident plane wave 14 is generated by a phased array or multiple electromagnetic wave beam array. The array dimension should be equal to or greater than the diameter $D_1$ of the secondary lens 10. When the array is scanned to $\pm\theta \approx = \pm m\phi_s$ substantial energy is not intercepted by the secondary lens 10. Typically, the generated electromagnetic wave is in the microwave range. Consequently, as shown in FIG. 2, absent the structural arrangement of FIG. 3, the secondary lens is required to be enlarged so as to intercept all of the array microwave energy created by the feed array indicated schematically at 18 and feeding secondary lens 10. The dotted lines 10' indicate the size of the lens needed to intercept the complete microwave energy generated by the feed array 18. $\theta_s$ is the maximum value of the angle of incident plane wave generated by a phase array or multiple beam array to be employed in the present invention.

Figure 3:
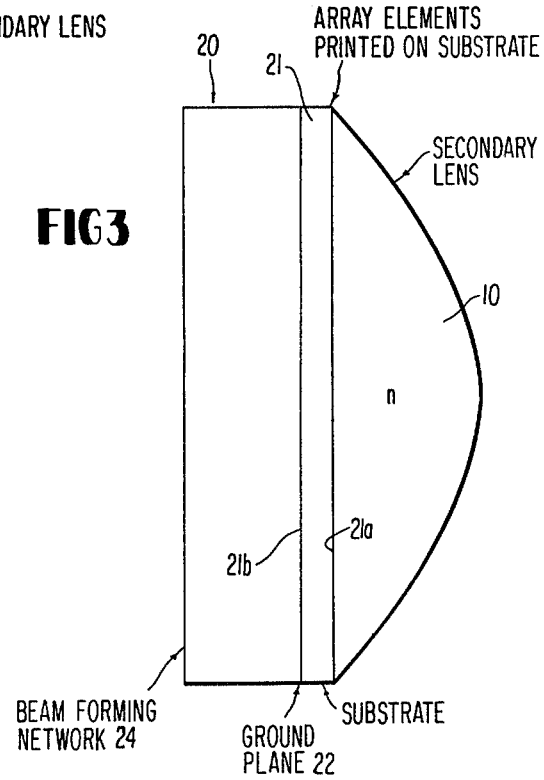
FIG. 3 is a schematic view of the integrated feed array and secondary lens assembly forming a principal component of the lens and antenna system of the present invention.
Figure 4:
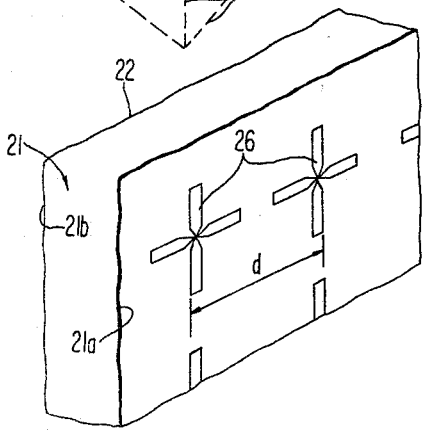
FIG. 4 is a perspective view of the substrate bearing the printed element array and ground plane of the integrated feed array and secondary lens assembly of FIG. 3.

FIG. 3 illustrates an important structural assembly forming a principal component of the integrated confocal microwave lens and feed antenna system of the present invention. The assembly 20 constitutes an integrated array and secondary lens assembly comprised of secondary lens 10, a substrate 21, a ground plane 22, and a microwave beam forming network indicated generally at 24. Array elements such as dipoles 26, FIG. 4, or crossed dipoles, spirals (not shown), etc., are printed on face $21_a$ of the substrate which face is in direct contact with the planar surface $10_a$ of the secondary lens 10. The elements are spaced a distance d from each other as shown. The substrate 21 preferably has the same refractive index as that of the secondary lens 10. Further, the opposite surface $21_b$ of the substrate 20 is backed by the ground plane 22. In turn, the radiation beam forming and control network indicated generally at 24 is directly connected to and overlies the substrate 21 via ground plane 22. Network 24 generates, for example, microwave radiation and is of the type set forth in the article entitled "Design of Hybrid Multiple Beam Forming Networks" by K. H. Hering and appearing in the publication "Phased Array Antennas" edited by Oliver and Knittel, published by Artech House, Denham, Massachusetts 1972.

Where a regular grid of elements are employed, the elements facing in the array should satisfy the inequality:

$$\frac{d}{\lambda} \leqq \frac{1}{n + \sin\theta_s}$$

where d is the distance between elements, $\lambda$ is the wave length of transmitted electromagnetic wave energy, n is the refractive index of the substrate, and $\theta$ is the maximum value of $\theta$ in order to avoid the emergence of grating lobes in the visible space.

For an array designed in free space, n=1, the conclusion is reached that the element spacing for the integrated array must be smaller than for the free space array. Consequently, more elements will be required.

By the utilization of the structural assembly 20 in FIG. 3, which includes the secondary lens 10 within the microwave system illustrated in FIG. 1, there is implemented a no-reflection, confocal, hyperboloidal lens system and feed system which need not be offset fed, and in which the secondary lens is of minimum diameter, volume and weight.

Further advantages are that the array element, such as the dipole, is designed to be intrinsically matched to the lens medium. Thus, the active impedance matching of the array and surface matching of the lens are reduced to the same (simpler) problem.

The array elements, ground plane and microwave beam forming and control networks are efficiently packaged with the lens as an integrated assembly.

Further, the main advantages of the confocal system are retained while employing the assembly of FIG. 3, the feed array size can be effectively magnified by the magnification of the lens system and large array performance can be realized with a relatively small array. Primary aberrations such as coma and astigmatism are reduced or eliminated, since the aberrations of the two lenses tend to cancel through the use of the optical arrangement of FIG. 1.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An integrated confocal electromagnetic wave lens and feed antenna system, said system comprising:

spaced, coaxial, hyperboloidal primary and secondary lenses, each of said lenses having a planar surface and a convex surface described by a hyperboloidal eccentricity equal to the refractive index of the lens, said lenses being mounted with their convex surfaces facing each other, said lenses having equal beam deviation factors, whereby for small scan angles, $$\phi = m\theta$$

where;

$\phi$ is the angle of incidence with the secondary lens of the incident plane wave, m equals the magnification of the lens system, and $\phi$ equals the angle of emergence of the emergent plane wave from the primary lens, said system further comprising; a feed array integrated with said secondary lens, said feed array comprising; array elements printed on a substrate, said substrate at said array elements being connected directly to and overlying the planar surface of said secondary lens, said substrate being backed by a ground plane and an electromagnetic wave beam forming and control network being directly connected to and overlying said substrate at said ground plane.

2. The integrated confocal lens and feed antenna system as claimed in claim 1, wherein said substrate has the same refractive index as the secondary lens.

3. The integrated confocal lens and feed antenna system as claimed in claim 1, wherein said array elements constitute a regular grid of elements and the element spacing in the array satisfies the inequality:

$$\frac{d}{\lambda} \leqq \frac{1}{n + \sin\theta_s}$$

where:

d is the distance between elements, $\lambda$ is the wave length of transmitted electromagnetic wave energy, n is the refractive index of said substrate, and $\theta_s$ is the maximum value of $\theta$.

4. The integrated confocal lens and feed antenna system as claimed in claim 2, wherein said array elements constitute a regular grid of elements and the element spacing in the array satisfies the inequality:

$$\frac{d}{\lambda} \leqq \frac{1}{n + \sin\theta_s}$$

where:

d is the distance between elements, $\lambda$ is the wave length of transmitted electromagnetic wave energy, n is the refractive index of said substrate, and $\theta_x$ is the maximum value of $\theta$.

5. An integrated feed array and secondary lens assembly for an integrated confocal electromagnetic wave lens and feed antenna system, said system comprising:

spaced, coaxial, hyperboloidal primary and secondary lenses, each of said lenses having a planar surface and a convex surface described by a hyperboloidal eccentricity equal to the refractive index of the lens, said lenses being mounted with their convex surfaces facing each other, and said lenses having equal beam deviation factors, whereby for small scan angles, $$\phi = m\eta$$

where:

$\phi$ is the angle of incidence of the plane wave transmitted to the secondary lens, m is the magnification of the lens system, and $\theta$ is the angle of emergence of the plane wave from the primary lens, said assembly comprising a substrate having array elements printed on one surface thereof, a ground plane formed on the opposite surface of said substrate, said one surface of said substrate bearing said array elements being connected directly to and overlying the planar surface of the secondary lens, and an electromagnetic wave beam forming and control network being directly connected to and overlying an opposite surface of said substrate at said ground plane.

6. The integrated feed array and secondary lens assembly as claimed in claim 5, wherein said substrate has the same refractive index as the secondary lens.

7. The integrated feed array and secondary lens assembly as claimed in claim 5, wherein said array elements constitute an irregular grid of elements, and the elements facing in the array satisfies the inequality:

$$\frac{d}{\lambda} \leqq \frac{1}{n + \sin\theta_s}$$

where:

d is the distance between elements, $\lambda$ is the wave length of transmitted electromagnetic wave energy, n is the refractive index of said substrate, and $\theta_s$ is the maximum value of $\theta$.

8. The integrated feed array and secondary lens assembly as claimed in claim 6, wherein said array elements constitute an irregular grid of elements, and the elements facing in the array satisfies the inequality:

$$\frac{d}{\lambda} \leqq \frac{1}{n + \sin\theta_s}$$

where:

d is the distance between elements,

80 is the wave length of transmitted electromagnetic wave energy, n is the refractive index of said substrate, and $\theta_s$ is the maximum value of $\theta$.

* * * * *

UNITED STATES PATENT AND TRADEMARK OFFICE

CERTIFICATE OF CORRECTION

PATENT NO. : 4,254,421

DATED : March 3, 1981

INVENTOR(S) : Randall W. Kreutel, Jr.

It is certified that error appears in the above—identified patent and that said Letters Patent is hereby corrected as shown below:

Column 1, line 14, change [abberation] to -- aberration ---

Column 2, line 58, change [$D_2$and] to --- $D_2$ and ---

Column 3, line 14, change [$\theta$] to --- $\phi$ ---

Column 3, line 23, change [$\theta$] to --- $\phi$ ---

Column 3, line 24, change [BDG] to --- BDF ---

Column 3, line 51, change [phase] to --- phased ---

Column 5, line 7, change [ $\phi$ ] to --- $\theta$ ---

Column 5, line 54, change [$\theta_x$ ] to --- $\theta_s$ ---

Column 6, line 9, change [ $n$ ] to --- $\theta$ ---

Column 6, ine 12, change [ $\phi$ ] to --- $\theta$ ---

UNITED STATES PATENT AND TRADEMARK OFFICE

CERTIFICATE OF CORRECTION

PATENT NO. : 4,254,421

DATED : March 3, 1981

INVENTOR(S) : Randall W. Kreutel, Jr.

It is certified that error appears in the above—identified patent and that said Letters Patent is hereby corrected as shown below:

Column 6, line 15, change [ $\theta$ ] to --- $\phi$ ---

Column 6, line 55, change [ 80 ] to --- $\lambda$ ---

Signed and Sealed this

*Twenty-eighth* Day of *July 1981*

[SEAL]

*Attest:*

GERALD J. MOSSINGHOFF

*Attesting Officer*

*Commissioner of Patents and Trademarks*